United States Patent [19]

Phelon et al.

[11] 4,232,284

[45] Nov. 4, 1980

[54] IGNITION COIL AND ELECTRICAL CONNECTOR THEREFOR

[75] Inventors: Russell E. Phelon, East Longmeadow, Mass.; Henry A. Hawken, Granby, Conn.

[73] Assignee: Power Parts, Inc., Carolina, P.R.

[21] Appl. No.: 36,851

[22] Filed: May 7, 1979

[51] Int. Cl.[3] ..... H01F 27/04; H01F 15/10

[52] U.S. Cl. ..... 336/90; 29/605; 336/192

[58] Field of Search ..... 336/90, 92, 96, 192, 336/105, 107, 198, 208; 29/605

[56] References Cited

U.S. PATENT DOCUMENTS

| | | | |
|---|---|---|---|
| 2,447,376 | 8/1948 | Tognola | 336/107 X |
| 3,163,840 | 12/1964 | Zack | 336/192 |
| 3,175,176 | 3/1965 | Henschke | 336/192 |
| 3,437,966 | 4/1969 | Tolley | 336/90 |

*Primary Examiner*—Thomas J. Kozma

*Attorney, Agent, or Firm*—Chapin, Neal & Dempsey

[57] ABSTRACT

Improved high tension coil and electrical connector for the ignition system of an internal combustion engine. The secondary of an ignition coil is wound with the outer turn thereof electrically connected to a foil strip disposed on the outer surface of the coil. The coil is fitted within a housing adjacent a terminal for connection to a spark plug cable. A spring contact electrically connects the cable to the foil strip carried by the coil, the spring being tensioned against said coil to insure good electrical contact and maintain the components in assembled relation for the potting operation.

4 Claims, 3 Drawing Figures

IGNITION COIL AND ELECTRICAL CONNECTOR THEREFOR

BACKGROUND

This invention relates to a high tension ignition coil in combination with an electrical connector to a spark gap device used with magnetomotive devices such as magneto ignition systems for internal combustion engines.

The secondary of an ignition coil also known as a high tension coil, generally comprises fine copper wire of a thickness in the neighborhood of 1-2 mils. In the assembly of an ignition system, this coil is connected to a lead wire or "spark plug wire" which connects the ignition system to the engine spark plug. Heretofore it has been the practice to solder the end of the high tension coil directly to a terminal or connector, such as a screw, pin or clip which makes contact with the conductor of the lead wire. Because of the extremely fragile nature of the high tension coil wire such assembly techniques are time consuming and require delicate handling, thereby adding substantially to the manufacturing costs of such coil structures. Moreover, the very fine secondary wire has a tendency to break when making such connections.

Accordingly, it is a principal object of the present invention to provide a high tension coil and connecting wire structure for a magnetomotive device which overcomes the deficiencies of the prior art.

It is another object to provide such a structure which is economical to manufacture.

It is another object to provide such a structure wherein the connection between the coil and connecting wire is of enhanced dependability and durability.

It is another object of the present invention to provide a method for manufacturing a high tension coil and wire connection which consistently yields connections of high quality.

SUMMARY OF THE INVENTION

These and other objects which will become more apparent from the following detailed description taken in connection with the accompanying drawings are achieved by providing a conductive flexible foil strip in conforming superposed relation on the coil. A terminal, which includes a spring contact member is electrically connected to the spark wire and extends to the foil strip on the coil where it is maintained in tensioned contact. The spring contact thus maintains positive electrical contact between the high tension coil and leadwire and retains the several components in assembled relation for the coil potting operation.

DESCRIPTION OF THE DRAWINGS

FIG. 3 is a perspective view illustrative of the manufacture of high tension coils in accordance with this invention.

DESCRIPTION OF PREFERRED EMBODIMENT

Figure 1:
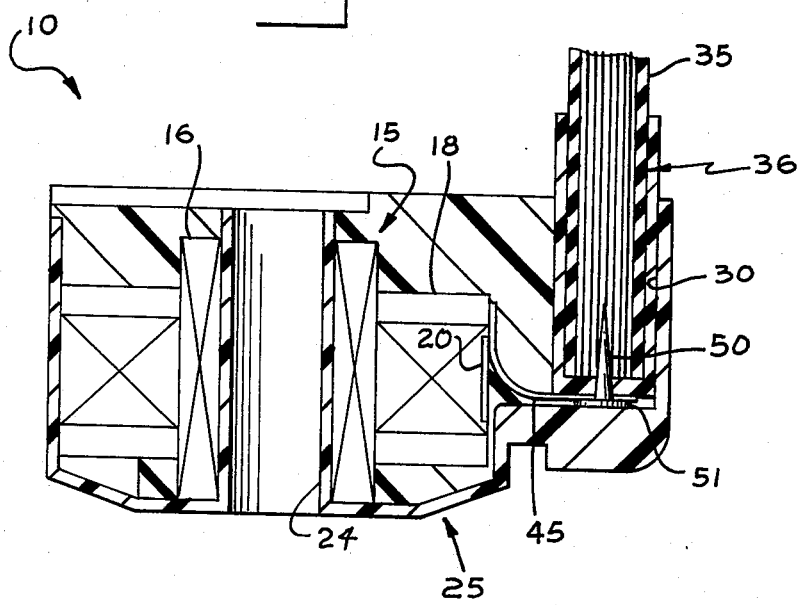
FIG. 1 is a partial elevational view in cross section of a high tension coil and connecting structure of the present invention.
Figure 2:
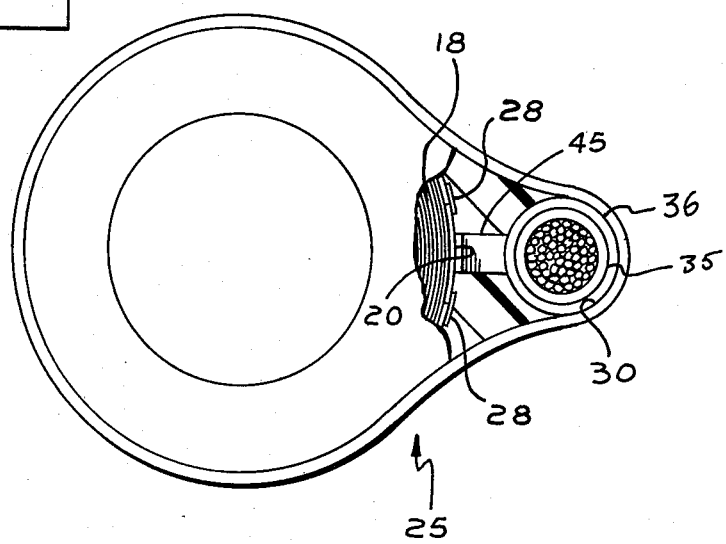
FIG. 2 is a top plan view of the structure of FIG. 1.
Figure 5:
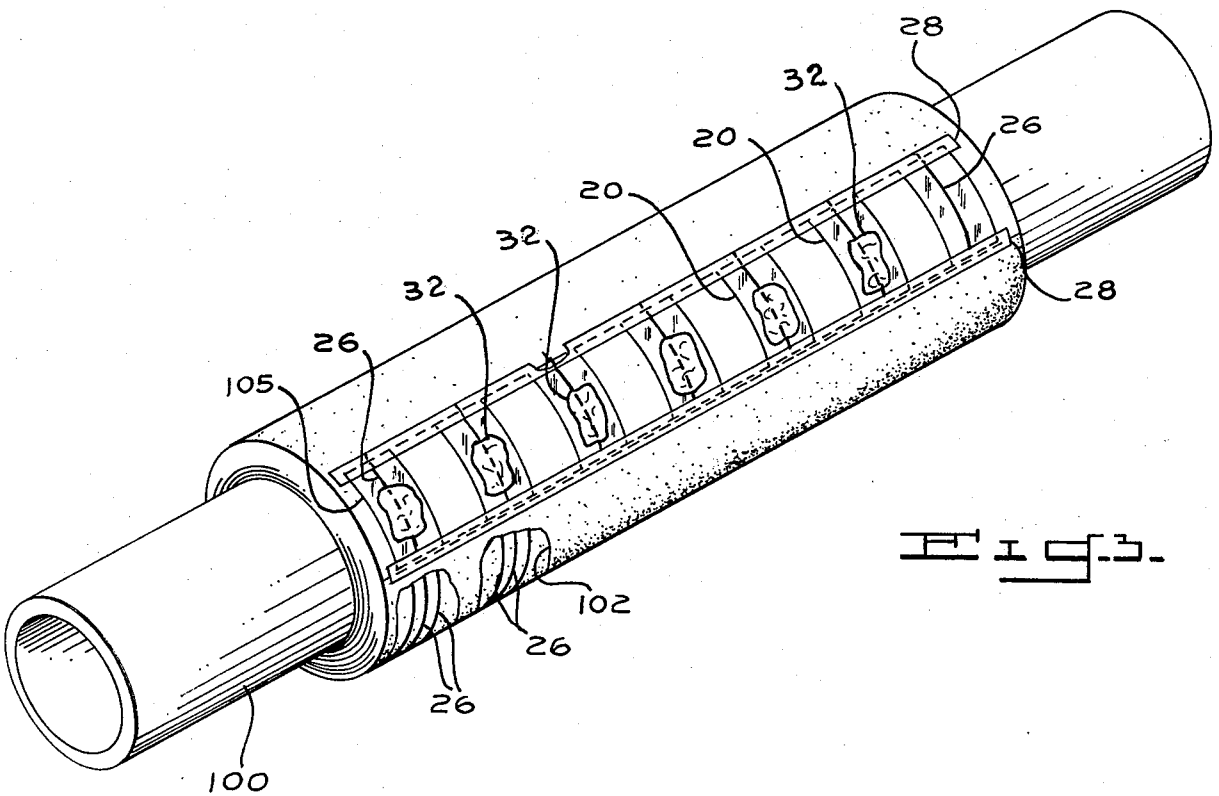

Referring to the drawings, a high tension coil and lead wire structure of the present invention is shown generally at 10. The structure comprises an ignition coil 15 including a primary 16 and secondary 18 and a contact strip 20 is connected to the outer turn of the coil. The coil 15 is disposed within a molded plastic housng 25 which includes a cable receiving chamber portion 30 adapted to receive the end of wire 35. Means for electrically connecting the coil and lead wire includes leaf spring contact 45 which has one end connected to the lead wire by brad type fastener 50 and the other end disposed in contact with foil 20.

Coil 15 comprises concentrically disposed primary and secondary portions 16 and 18 respectively, the primary winding being connected usually to breaker points or breakerless ignition (not shown) for cyclically interrupting the current flow therein which causes a voltage pulse to be induced in the secondary winding 18 which is conducted by lead wire 35 to a spark gap device. Since the secondary voltage must be of sufficient magnitude to overcome the resistance of the spark plug gap, the secondary winding comprises a relatively large number of windings of very fine copper wire on the order of 1-3 mils thick. In the preferred embodiment, the coil 18 comprises a build-up of wire turns separated into a spiral of concentric layers by dielectric paper convolutely wound in coil form with the wires (FIG. 3).

Housing 25 is generally cup-shaped shell of molded synthetic plastic having an upstanding chimney 24 for receiving and positioning the coil 15 within the housing 25 with the foil 20 on the outer surface of the secondary coil 18 disposed adjacent the chamber 30 into which lead wire 35 is fitted. The end of the lead wire is disposed in a plastic tubular socket 36 closed at its outer end.

As best shown in FIG. 3 which illustrates a preferred method of fabricating a plurality of high tension coils as an integral structure or so called "stick" severable into individual coils. The outermost winding 26 of the coil 18 comprises a single turn which is connected at the end thereof to contact 20. In the preferred embodiment the contact comprises a flexible foil of electrically conductive material such as a copper foil affixed to the coil by any suitable means such as a pressure sensitive adhesive coated tape 28 applied along the opposite ends of the foil strips 20. The ends of the windings 26 are soldered as at 32 to the foil strips 20. After completion of the continuous structure, the "stick" is severed into individual coils which may be assembled within the housing 25 with the foil 20 disposed adjacent chamber 30.

One end of an insulated lead wire 35 is fitted into socket 36 with its free end being pierced by the pointed end of fastener 50 which extends through end wall of socket 36 and embeds itself in the conductive core 37 of the lead wire. The fastener has an enlarged head 51 which holds one end of the leaf spring 45 against the end of the socket for assembly within the chamber 30 of the housing 25. When so assembled, the outer end of the spring contact 45 is disposed for engagement with the foil contact 20 on the coil 18.

The spring contact 45 comprises a thin member of copper or other electrical conductor which is compressed against foil contact 20 and holding the lead wire and coil in assembled relation within the housing 25. In the preferred embodiment, the spring is of the leaf or reed type, extending outwardly of the end of socket 36 and rearwardly in a direction opposite to that used for insertion of the socket into the housing 25. Thus, it will be understood that in assembly, the terminal socket fits readily into the housing chamber 30, but spring 45 resists removal because its free end tends to catch or bite into the coil contact thereby returning the terminal socket within the housing and enhancing the effectiveness of the electrical connection between those two components. This function may also be obtained by a contact of heavy conductor wire extending outwardly of the terminal in lieu of the reed shaped member 45. The wire may be a spring metal or be urged against the foil contact by a resilient or elastic material (not shown).

The structure of coil 18 is adaptable to economical manufacture involving a minimum of manipulation of the fine secondary wire 26 whereby the incidence of breakage is minimized. The coil is fabricated as a wound laminated structure with alternate layers of copper wire and dielectric paper. Referring to FIG. 3 a plurality of coils 18 are simultaneously wound on a mandrel 100. Alternate layers of copper wire 26 and dielectric paper 102 are convolutely wound on the rotating mandrel 100 until the correct number of wire turns and paper layers are obtained. At that time a terminal strip 105 is applied to the outer surface of the coil. The terminal strip comprises a strip or ribbon of insulating material such as a synthetic plastic film or paper approximately the same length as the integral coil structure. A plurality of foil contacts or strips 20 are carried on the insulating film 105 at laterally spaced locations corresponding to the number of coils being fabricated. The foils which may be about $\frac{1}{4}''$ in width axially of the coil and $1\frac{1}{2}''$ in length extend over only a portion of the circumference of the coil to minimize the capacitive effect. Before cutting the wires 26, the strip 105 is placed on the outer surface of the coil structure with the foil strip registered with coil wires 26. The wires 26 and strip 105 are held in fixed position on the coil by any suitable means such as strips or tapes 28 coated with pressure sensitive adhesive and the wires terminated.

When the composite paper and copper foil strip 105 is so applied, the end wire 26 of each coil is laid thereover and bonded to the foil as by soldering as at 32 in a wave type solder bath. In this type of soldering technique molten solder is applied to the terminal sites with a minimum of coil handling being required.

A terminal connection for the coil may be assembled by "nailing" the spring contact 45 to the closed end of the socket 36 with a tack type fastener 50 and lead wire 35 is then connected to the terminals simply by the insertion of its bared end into the socket, impaling the end on the tack. The terminal is then assembled by inserting it into chamber 30 of the coil housing with contact 45 disposed against the terminal foil portion of the coil. The spring contact not only makes firm electrical contact with the foil but holds the coil and lead wire socket in assembled relation for the coil potting operation by which a suitable plastic compound encapsulates the coils and connections to the lead wire.

Having thus described the invention, what is claimed is:

1. Ignition coil for an internal combustion engine comprising a housing, a secondary coil disposed within said housing and being convolutely wound of alternate layers of conductor wire and insulating paper, the outer end of said conductor wire being bonded in electrical contact with a conductive foil terminal disposed on the outer surface of the coil, a lead wire extending into said housing for connecting the voltage induced in said secondary coil to a spark gap device of the engine, a spring contact member interconnecting in a tensioned condition said lead wire and said conductive foil terminal.

2. Ignition coil as set forth in claim 1 wherein the terminal end of said lead wire is disposed within a tubular socket, one end of said spring contact being affixed to the end of said socket by means of a headed fastener extending through the end wall of said socket and penetrating the lead wire in electrical connection therewith, the outer end of said spring contact extending outwardly and rearwardly from the end of said socket to which it is attached.

3. Ignition coil as set forth in claim 2 wherein said lead wire with the socket disposed on the end thereof is fitted into a chamber provided in said housing adjacent the outer surface of said secondary coil, the spacing between said coil and socket being less than the outward extension of the contact member therefrom whereby the contact member engages the outer surface of said coil.

4. Ignition coil as set forth in claim 2 wherein said spring contact comprises a reed affixed to said socket, and extending generally outwardly of said socket in a direction opposite that of insertion of said receptacle into said housing whereby the removal of said receptacle from said structure is restricted by engagement of the free end of said reed with said coil contact.

* * * * *